United States Patent [19]

D'Alessio

[11] 4,348,820

[45] Sep. 14, 1982

[54] SHOE STRUCTURE

[76] Inventor: Antonio D'Alessio, 208 Bay 44th St., Brooklyn, N.Y. 11214

[21] Appl. No.: 230,443

[22] Filed: Feb. 2, 1981

[51] Int. Cl.[3] ..... A43B 3/24; A43B 3/12

[52] U.S. Cl. ..... 36/101; 36/11.5

[58] Field of Search ..... 36/100, 101, 11.5

[56] References Cited

U.S. PATENT DOCUMENTS 2,607,133 8/1952 Marlowe ..... 36/101

3,000,116 9/1961 Ally ..... 36/101

*Primary Examiner*—Patrick D. Lawson

*Attorney, Agent, or Firm*—Hedman, Casella, Gibson & Costigan

[57] ABSTRACT

A new and improved shoe structure is disclosed which may be rapidly assembled to define a sturdy secure construction. The subject shoe structure includes an elongated base member having a top surface circumscribed by an upstanding ridge to define a hollowed-out recess. A plurality of locking pins are formed integrally with the ridge and project perpendicularly outwardly therefrom towards the interior of the recess. An elongated strap having a plurality of pin receiving apertures located at the opposed ends thereof is mounted to the base member with the pins of the latter being received in the apertures of the strap. An insole having a configuration substantially conforming to the hollowed-out recess is provided and is mounted within the recess, with the lower surface thereof being bonded to the top surface of the base member. By this arrangement, the locking pins and the opposed ends of the strap are interposed between the base member and the strap to provide a sturdy integral shoe structure.

10 Claims, 4 Drawing Figures

SHOE STRUCTURE

BACKGROUND OF THE INVENTION

The subject invention relates to a new and improved shoe structure. More particularly, a shoe structure is disclosed which is relatively simple to assemble and includes a positive locking feature to achieve an integral sturdy unit.

In the prior art, a variety of shoe structures and method of construction have been utilized. More specifically, shoe structures are known which include an elongated base having one or more straps connected thereto. The straps or vamps are provided for holding the shoe on the wearer's foot.

A variety of construction methods are known in the prior art to initially locate the vamp, relative to the shoe base, and thereafter connect the members together. For example, in a well known lasting procedure, the vamp is wrapped around a foot-shaped form or "last", facilitating its orientation and subsequent attachment to the base. The attachment methods include stitching, stapling, rivets and other fasteners. One major shortcoming of these prior art construction methods is that lasting and stitching are generally slow, hand operations which must be carried out by skilled artisans, therefore greatly increasing the cost of the product. Examples of some of these latter prior art shoe constructions can be found in U.S. Pat. No. 2,157,818, issued May 9, 1939 to Disch; U.S. Pat. No. 3,841,003, issued Oct. 15, 1974 to Huyge; and U.S. Pat. No. 2,468,863, issued May 3, 1949 to Burns.

In order to overcome the shortcomings of the prior art complex lasting and stitching operations, other shoe constructions have been developed for connecting the vamp to the base member. The latter prior art structures can be evaluated based on a number of desirable characteristics. For example, the connection must be relatively simple and easy to assemble, enabling unskilled labor to rapidly construct the shoe. The connection must also be strong to withstand the constant strains of walking. Further, it is desirable that the connection be concealed such that the aesthetic appearance of the shoes is not diminished.

One example of such a prior art structure can be found in U.S. Pat. No. 3,599,353, issued Aug. 17, 1971 to Magidson. In the Magidson patent, an intermediate insole member is provided having a plurality of slots therein for receiving elongated straps or vamps. After the ends of the vamps are threaded through the intermediate insole, they are connected to downwardly projecting tabs provided on the lower surface of the insole. The insole-vamp combination is then connected to a base and an additional upper insole is connected on top of the intermediate insole. As can be appreciated, while the shoe structure in Magidson provides for a concealed strap connection, it is relatively complex and rather difficult to assemble. Other examples of shoe structures having connections between the vamp and the body portion of the shoe can be found in U.S. Pat. No. 178,385, issued June 6, 1876 to Sheffield; U.S. Pat. No. 2,367,232, issued Jan. 16, 1945 to Marx; U.S. Pat. No. 3,672,078, issued June 27, 1972 to Fukuoka; U.S. Pat. No. 3,785,070, issued Jan. 15, 1974 to Stafford; U.S. Pat. No. 3,890,725, issued June 24, 1975 to Lea et al; and U.S. Pat. No. 3,928,927, issued Dec. 30, 1975 to Brown et al. All of the above cited patents disclose shoe structures which fail to satisfy some or all of the above stated desirable characteristics.

Other examples of prior art shoe structures include removable connections between the vamp and the shoe bottom to allow the vamp to be interchanged for another vamp of a different color. Examples of such interchangeable connections can be found in U.S. Pat. No. 2,761,224, issued Sept. 4, 1956 to Gardiner; U.S. Pat. No. 2,889,639, issued June 9, 1959 to Rudine; U.S. Pat. No. 3,000,116, issued Sept. 19, 1961 to Ally; U.S. Pat. No. 3,016,630, issued Jan. 16, 1962 to Twiggs, Jr.; U.S. Pat. No. 3,902,259, issued Sept. 2, 1975 to Cracco; and U.S. Pat. No. 4,193,214, issued Mar. 18, 1980 to Wang. As can be appreciated, removable connections, while permitting vamps to be interchanged, are generally undesirable in that they cannot provide the superior strength of a permanent connection. In order to compensate for the inherent weakness of a removable connection, many of the prior art structures are relatively complex in order to increase the rigidity of the construction. Another disadvantage of the prior art removable connections is that since ready access to the connections must be provided to permit disengagement, they are generally not concealed thereby diminishing the aesthetic appearance of the shoe.

Accordingly, it is an object of the subject invention to provide a new and improved shoe structure which is relatively simple in construction and yet provides an extremely stable and sturdy connection between the vamp and the base of the shoe.

It is another object of the subject invention to provide a new and improved shoe structure which includes a positive locking arrangement between the vamp and the shoe bottom.

It is a further object of the subject invention to provide a new and improved shoe structure wherein the connection between the vamp and the base member is concealed such that the aesthetic appearance of the shoe is not diminished.

It is still another object of the subject invention to provide a new and improved shoe structure which may be rapidly assembled and eliminates the necessity of using a lasting procedure.

SUMMARY OF THE INVENTION

In accordance with these and many other objects, the subject invention provides for a shoe structure including an elongated base member having a top surface which is circumscribed by an upstanding ridge. The top surface and the ridge cooperate to define a hollowed-out recess. The base member is further provided with a plurality of resilient locking pins which project perpendicularly from the ridge towards the interior of the recess. Preferably, the locking pins are formed unitary with the base member and extend parallel to the plane of the top surface of the base member.

An elongated strap or vamp is provided having pin receiving apertures disposed at the opposed ends thereof. The vamp is readily mounted on the base member with the locking pins projecting through the apertures provided in the vamp. An insole is provided having a configuration substantially conforming to the configuration of the hollowed-out recess. The insole is mounted within the recess, with the lower surface thereof being bonded to the top surface of the base member. By this arrangement, the locking pins of the base member and the opposed ends of the vamp are securely interposed between the base member and the insole. Since the pins are formed of a resilient material, when the insole is mounted in the recess, the free ends of the pins are biased downwardly into contact with the top surface of the base member, thereby securely locking the vamp to the base member.

The subject shoe structure is sturdy in construction and resists breakage during use. More specifically, the downward force on the insole provided by the weight of the wearer, tends to keep the vamp securely engaged with the locking pins of the base member. The subject structure is not complex and therefore can be readily assembled by unskilled labor. Another advantage of the subject structure is that the connections between the vamp and the connecting pins are concealed such that the aesthetic appearance of the shoe is not diminished.

Other objects and advantages of the subject invention will become apparent from the following detailed description taken in conjunction with the drawings in which:

BRIEF DESCRIPTION OF THE PREFERRED EMBODIMENT

Figure 1:
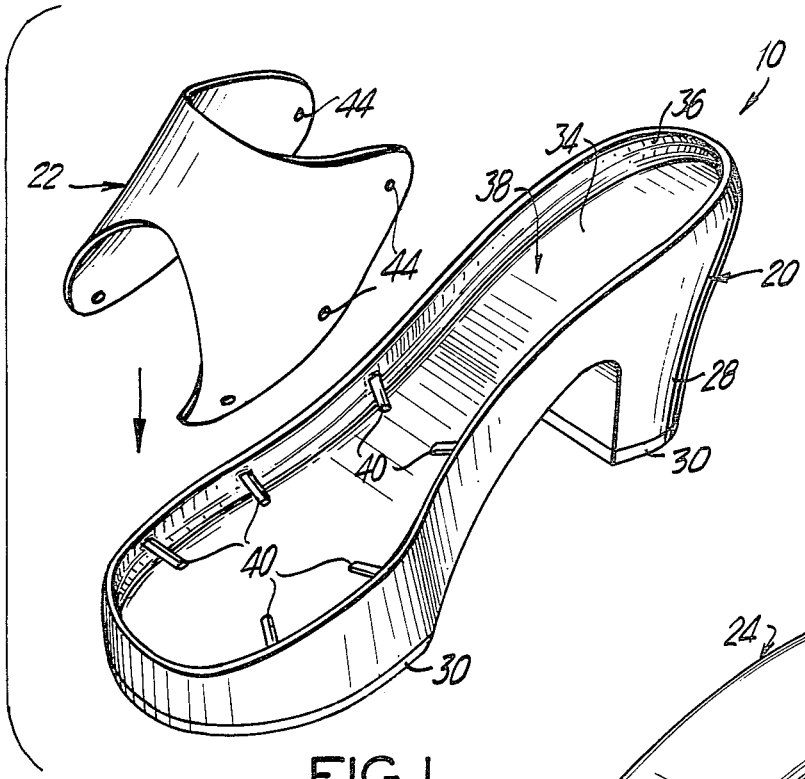
FIG. 1 is an exploded perspective view illustrating the base member and vamp forming a portion of the new and improved shoe structure of the subject invention.
Figure 2:
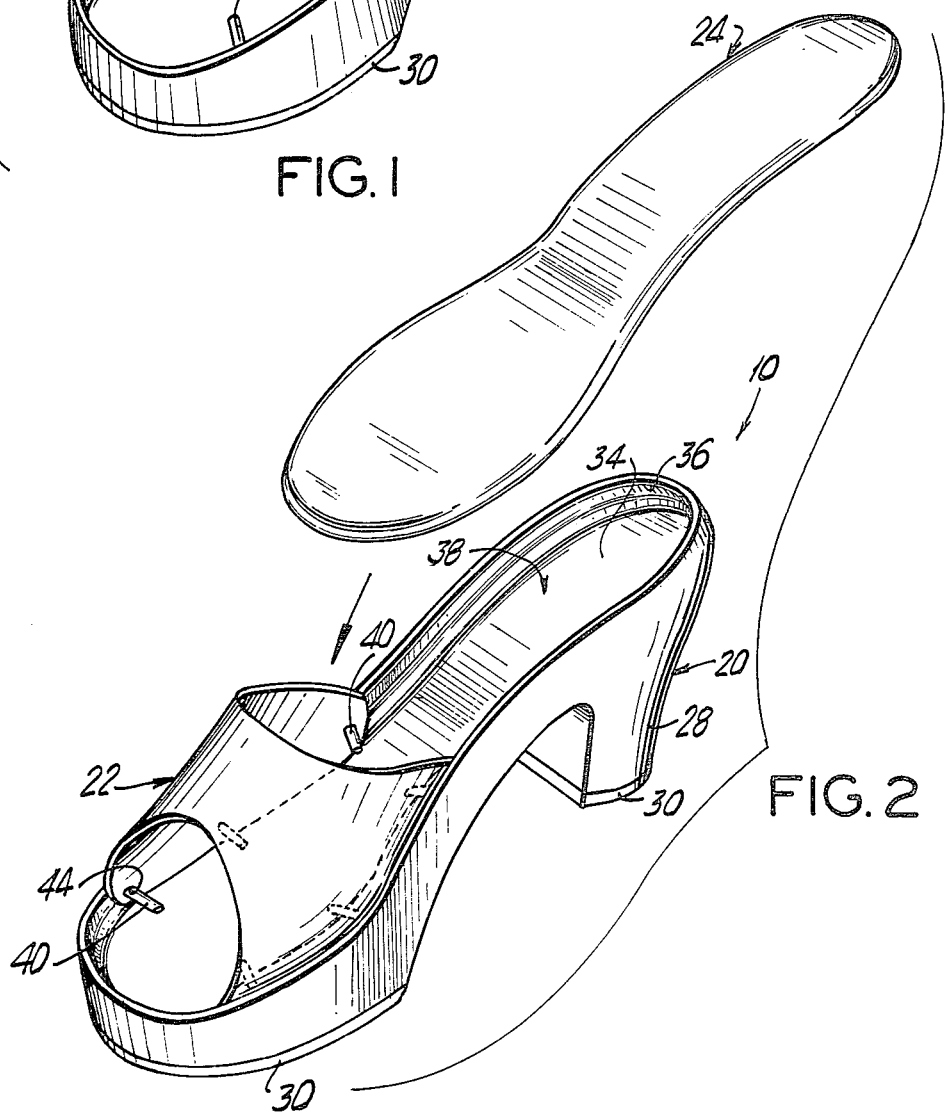
FIG. 2 is an exploded perspective view illustrating the insole and the base member with connected vamp, of the new and improved shoe structure of the subject invention.

Referring to FIGS. 1 and 2, there is illustrated the new and improved shoe structure 10 of the subject invention. The subject shoe structure 10 includes a base member 20, a vamp 22 and an insole 24. Base member 20 has an elongated configuration substantially conforming to the shape of a human foot. The base member 20 may be provided with a planar bottom, or any type of heel 28, as illustrated. Preferably, the base member 20 is unitary in construction, and formed from a plastic material by an injection molding technique. The plastic injection molding of base member 20 facilitates mass production and is particularly suited to the shoe structure 10 of the subject invention. The base member 20 may also be provided with rubber soles 30 to improve friction, reduce slippage and increase wear.

As illustrated in FIG. 1, the top surface 34 of the base member 20 is circumscribed by an upstanding ridge 36. The top surface 34 and the upstanding ridge 36 cooperate to define a hollowed-out recess 38. In accordance with the subject invention, a plurality of locking pins 40 are provided which are preferably formed integrally with the upstanding ridge 36 and project outwardly therefrom, towards the interior of the recess 38. Preferably, the locking pins 40 extend perpendicular to the ridge 36 and parallel to the top surface 34 of the base member 20. The location and arrangement of locking pins 40 is dependent upon the desired shape and mounting location of the vamp. For example, and as illustrated in FIGS. 1 and 2, when the vamp is intended to engage with the front portion of the wearer's foot and therefore extends from the front of the shoe to a midway point, locking pins 40 are disposed in opposed pairs along the sides of the ridge 36. Preferably, the locking pins 40 are resilient enabling them to be biased downwardly during the assembly of the shoe to define a secure locking arrangement, as more fully described hereinafter.

Vamp 22 is an elongated strap having a configuration determined, in part, by aesthetic considerations. Vamp 22 is preferably formed from leather or any other suitable substitute. In accordance with the subject invention, the opposed ends of the vamp 22 are provided with a plurality of pin receiving apertures 44 which correspond to the placement and location of the locking pins 40 of the base member 20. As illustrated in FIG. 2, by this arrangement, the vamp may be readily installed on the base member with the locking pins 40 being received in the corresponding apertures 44 of the vamp. This assembly procedure may be rapidly carried out with unskilled labor. Another advantage of the subject connection is that the vamp can be readily oriented and initially located in the proper position. Further, this position is securely maintained by the pins 40 throughout the assembly of the shoe structure.

Figure 4:
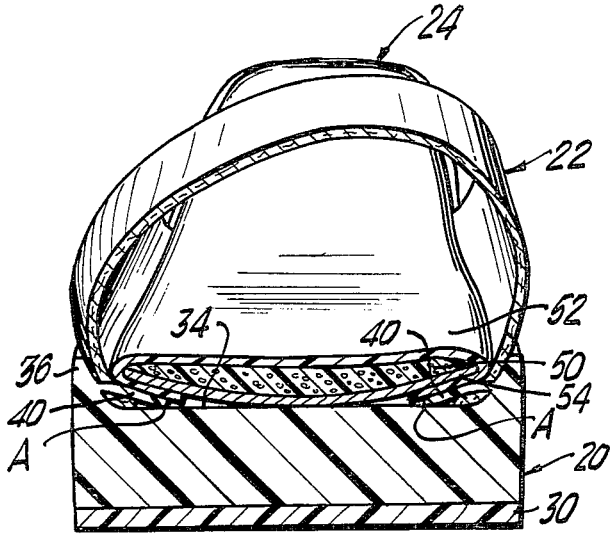
FIG. 4 is a cross sectional view, taken along the line 4—4 of FIG. 3, of the new and improved shoe structure of the subject invention.

Insole 24 consists of a pad having a planar configuration substantially conforming to the configuration of the hollowed-out recess 38 of the base member 20. As illustrated in FIG. 4, insole 24 may include a central cushion material 50 to provide added comfort for the wearer. The top layer 52 of the insole is preferably formed from a leather or vinyl material. The bottom layer 54 is preferably formed from a composition which enhances bonding with the top surface 34 of plastic member 20.

Figure 3:
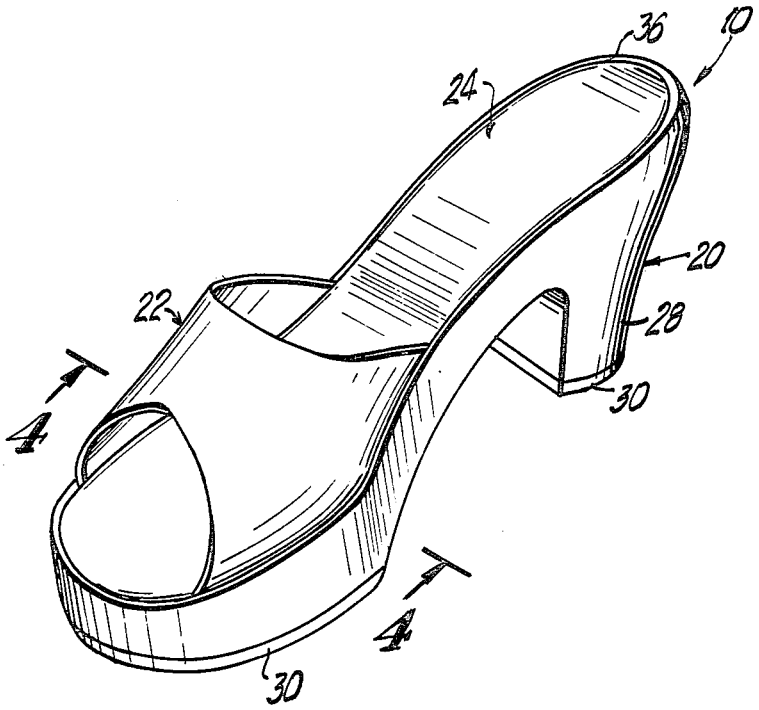
FIG. 3 is a perspective view of the new and improved shoe structure of the subject invention.

In the final assembly step of the shoe structure 10 of the subject invention, insole 24 is mounted in the hollowed-out recess 38 of the base member 20, as illustrated in FIGS. 3 and 4. The lower surface 54 of the insole is adhesively connected or otherwise bonded to the upper surface 34 of the base member. Preferably, the thickness of the insole 24 substantially conforms to the depth of recess 38 such that the upper surface of the insole is essentially coplanar with the top edge of ridge 36.

The bonding of the insole 24 to the base member 20 functions to secure the connection between the vamp 22 and the base member. More specifically, and as illustrated in FIG. 4, the locking pins 40 of the base member and the opposed ends of the vamp 44 are secured between the top surface 34 of the base member and the bottom surface 54 of the insole 22. Further, due to the resilient characteristics of locking pins 40, the insole 24 functions to downwardly bias the free ends of the pins into contact with the top surface 34 of the base, at points A. By this arrangement, a locking action is achieved which prevents the vamps from being released from the locking pins 40. As can be appreciated, the downward force of the weight of the wearer functions to maintain the locking pins in the downwardly biased position thereby insuring that the vamp remains connected to the shoe. The insole also functions to overlap and conceal the connection between the vamp and the base such that the aesthetic appearance of the shoe structure 10 is not diminished.

Accordingly, there has been provided a new and improved shoe structure 10 which is relatively simple in construction and can be readily and rapidly assembled with unskilled labor. More specifically, a shoe structure is disclosed which does not need to be assembled with prior art lasting techniques and in addition, does not require complex mechanical connections. The subject shoe structure includes an elongated base member 20 having a top surface 34 which is circumscribed by an upstanding ridge 36. The top surface 34 and the upstanding ridge 36 cooperate to define a hollowed-out recess 38. A plurality of locking pins 40 are provided which project perpendicularly from the ridge towards the interior of the recess. An elongated vamp 22 is provided having a plurality of pin receiving apertures 44 located at the opposed ends thereof enabling it to be mounted to the base member 20, with the locking pins of the latter being received in the apertures of the vamp. An insole member 24 has a configuration substantially conforming to the hollowed-out recess 38 of the base, and is mounted therein with the lower surface thereof being bonded to the top surface 34 of the base member. By this arrangement, the locking pins 40 and opposed ends of the vamp are interposed between the base member and insole to define a secure locking configuration. Preferably, the locking pins are resilient enabling them to be biased and deflected downwardly to prevent the vamp from becoming disengaged therefrom.

It is noted that the shoe structure 10 may be constructed in such manner as to include a second set of locking pins 40 disposed in the base member in the area of the heel 28 for connection to a back strap which is releasably secured to the ankle portion of the wearer. Accordingly, two sets of locking pins 40 would be provided in a type of shoe including a vamp and a back strap. Also, the base member 20 may be molded in two portions, with the upstanding circumferential ridge 36 and locking pins 40 being formed as a separate portion. The two portions would then be suitably secured together to form base member 20.

While the subject invention has been described with reference to a preferred embodiment, it will be apparent to one skilled in the art that variations may be made herein without varying from the scope or spirit of the subject invention as defined by the appended claims.

What is claimed is:

1. A shoe structure comprising:

an elongated base member having a top surface which is circumscribed by an upstanding ridge, said top surface and said ridge cooperating to define a hollowed-out recess, said base member further including a plurality of locking pins projecting from said ridge towards the interior of said recess;

an elongated strap member having a plurality of pin receiving apertures located at the opposed ends thereof, said strap member being mounted to said base member with said pins of said base member being received in said apertures of said strap member; and an insole member having a configuration substantially conforming to said hollowed-out recess and mounted therein, with the lower surface thereof being bonded to said top surface of said base member and with said locking pins and said opposed ends of said strap member being interposed between said inside and base members, whereby said base, strap and insole members form a sturdy integral shoe.

2. A shoe structure as recited in claim 1 wherein said base member, including said ridge and said locking pins, are of unitary construction.

3. A shoe structure as recited in claim 2 wherein said base member is formed of plastic material by an injection molding technique.

4. A shoe structure as recited in claim 1 wherein said base member includes a bottom surface and wherein said bottom surface includes a covering layer for increased wear.

5. A shoe structure as recited in claim 1 wherein said locking pins of said base member are resilient and are biased downwardly by said insole member such that the free ends thereof are in contact with said top surface of said base member to define a secure locking configuration.

6. A shoe structure as recited in clain 1 wherein said insole member includes an intermediate layer formed from a cushion material.

7. A shoe structure as recited in claim 1 wherein said locking pins are disposed in opposed pairs along the sides of said upstanding ridge.

8. A shoe structure as recited in claim 1 wherein the depth of said recess substantially conforms to the thickness of said insole.

9. A shoe structure comprising:

an elongated base member having a top surface which is circumscribed by an upstanding ridge, said top surface and said ridge cooperating to define a hollowed-out recess, said base member further including a plurality of resilient locking pins projecting laterally from said ridge towards the interior of said recess, said base member, including said ridge and said locking pins being unitary in construction and formed from a plastic material;

an elongated strap member having a plurality of pin receiving apertures located at the opposed ends thereof, said strap member being mounted to said base member with said pins of said base member being received in said apertures of said strap member; and an insole member having a configuration substantially conforming to said hollowed-out recess and mounted therein with the lower surface thereof being bonded to said top surface of said base member, and with said locking pins and said opposed ends of said strap member being interposed between said insole and base members, and with said locking pins being biased downwardly such that the free ends thereof are in contact with said top surface of said base member such that a secure locking configuration is defined.

10. A shoe structure as recited in claim 9 wherein said locking pins are disposed in opposed pairs along the sides of said upstanding ridge.

* * * * *